US005322332A

United States Patent [19]

Toledo et al.

[11] Patent Number: 5,322,332

[45] Date of Patent: Jun. 21, 1994

[54] RIM TYPE LATCHING SYSTEM

[75] Inventors: George Toledo, Fall Brook; Petros Z. Mantarakis, Northridge, both of Calif.

[73] Assignee: Thomas Industries, Inc., Los Angeles, Calif.

[21] Appl. No.: 962,460

[22] Filed: Oct. 16, 1992

[51] Int. Cl.[5] ..... E05B 65/10; E05B 63/20

[52] U.S. Cl. ..... 292/92; 292/21; 292/333

[58] Field of Search ..... 292/92, 21, 336, 333

[56] References Cited

U.S. PATENT DOCUMENTS

| | | | |
|---|---|---|---|
| 2,887,336 | 5/1959 | Meyer | 292/21 |
| 2,908,523 | 10/1959 | Foster | 292/21 X |
| 2,959,440 | 11/1960 | Hay | 292/21 X |
| 3,083,560 | 4/1963 | Scott | 292/21 X |
| 3,123,387 | 3/1964 | Jackson et al. | 292/21 |
| 3,940,886 | 3/1976 | Ellingson, Jr. | 49/319 |
| 3,993,335 | 11/1976 | Schmidt | 292/21 |
| 4,283,882 | 8/1981 | Hubbard et al. | 292/21 X |
| 4,839,988 | 6/1989 | Betts et al. | 49/141 |
| 5,114,192 | 5/1992 | Toledo et al. | 292/21 |
| 5,161,837 | 11/1992 | O'Brien, II | 292/21 X |

*Primary Examiner*—Rodney M. Lindsey
*Attorney, Agent, or Firm*—Hill, Steadman & Simpson

[57] ABSTRACT

A latch assembly for use with a panic exit device, particularly a top latch having a U-shape which engages a stem portion of a T-shaped receiving lug mounted overhead to a top member of the door frame. The U-shaped top latch is pivotably mounted to the active stile of the door. The latch assembly causes the U-shaped latch to pivot upward to capture the stationary T-shaped receiving lug, or pivot downwardly to disengage from the T-shaped receiving lug. The latch member is in sliding and abutting engagement with two latch plates which slide in one direction to retain the latch member in a downward orientation to hold the latch in an open position, and slide in an opposite direction to allow the latch member to pivot upwardly upon engaging pressure by the strike. A wedge is caused to slide into blocking engagement with the latch when it is in the closed position. The wedge is removed from the blocking position by movement of a panic bar of a panic exit device mounted onto the door, and the wedge, once moved to disengage from the latch member, allows the latch to pivot to the open position.

9 Claims, 7 Drawing Sheets

FIG. 8
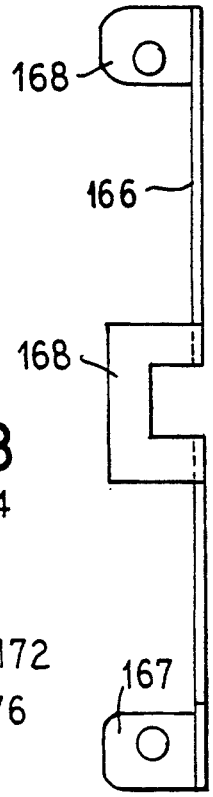
FIG. 9
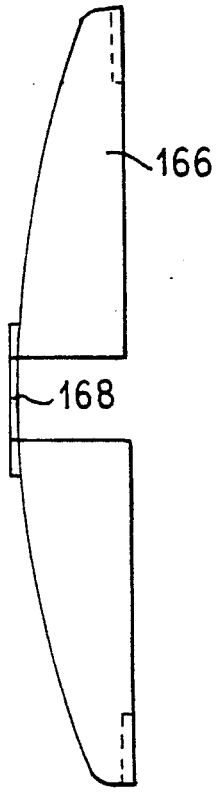
FIG. 11
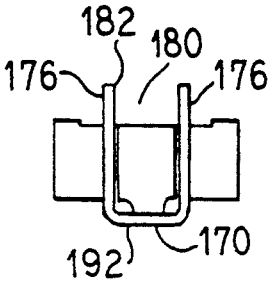
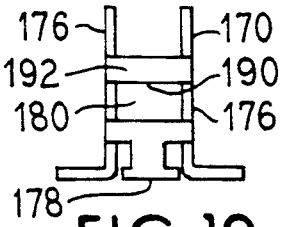
FIG. 12
FIG. 13
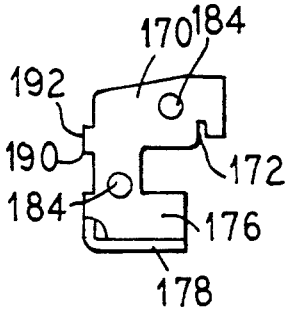
FIG. 10
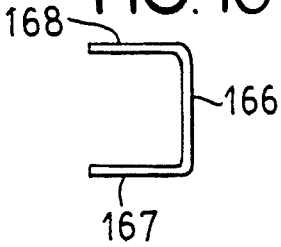
FIG. 15
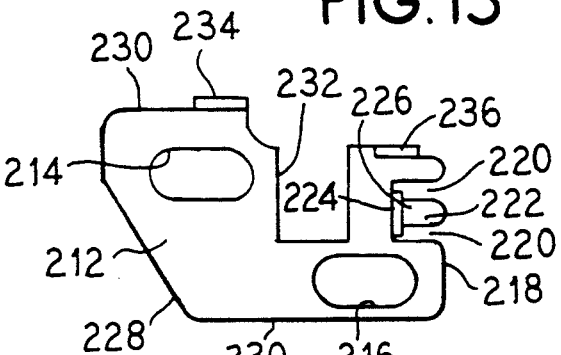
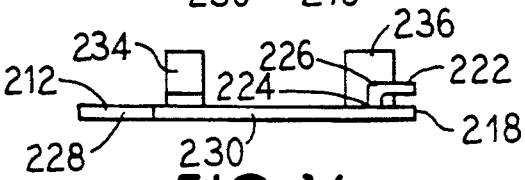
FIG. 16

RIM TYPE LATCHING SYSTEM

BACKGROUND OF THE INVENTION

This invention relates to panic exit devices having one or more latches carried by the door which engage receiving portions mounted on door frameworks surrounding the door. In particular, the invention relates to panic exit devices having one or more vertically operating latches at the top and/or bottom of the door. Examples of such devices wherein the bolts may be retracted by a panic exit device are described in U.S. Pat. No. 3,993,335 to Schmidt, U.S. Pat. No. 3,940,886 to Ellingson, Jr., U.S. Pat. No. 4,839,988 to Betts et al and U.S. Pat. No. 5,114,192 to Toledo et al.

There are numerous types and styles of mechanisms used for operating the popular commercial and industrial door latches wherein the latches such as bolts extend vertically from the top and bottom of the door and engage the top and bottom door frame members. These devices can include a panic bar release mechanism on one side of the door for rapid release of the bolts by depressing the panic bar to open the door.

Another desirable feature of a latch system is a provision wherein after the latch is disengaged by actuating the panic exit device, the latch is retained in a condition for easy re-engagement when the door closes. In an extending bolt-type latch a mechanism for retaining the retracted bolt in a retracted position after the door is opened and continuously while the door is opened, can serve this function. This feature prevents the need to continue pressure on the panic bar or the key in order to prevent the bolt from interfering with objects such as the ground or the door frame while the door is being opened and returned to the closed position. Thus, the bolt retaining mechanism is designed to hold the bolt in a retained condition and to trigger and release the bolt when the door again reaches the closed position. U.S. Pat. Nos. 5,114,192, 4,283,882, 3,993,335 and 3,334,500 show such bolt or latch mechanisms.

SUMMARY OF THE INVENTION

The invention disclosed herein provides an improved panic exit device latching mechanism. The invention provides a latch which, rather than vertically extending from the door to engage the door frame, rotatably engages a receiving member mounted on the door frame, similar to that disclosed in U.S. Pat. No. 5,114,192. This latching mechanism, upon mechanical instructions from the actuation of the panic exit device, or other device such as a key lock, is rotated into a disengaging position to allow the door to be opened. A latch mechanism, such as that disclosed in U.S. Ser. No. 787,261 filed on Nov. 4, 1991, and incorporated herein by reference, can be used to open the door.

The invention also provides for a smooth and foolproof re-engagement of the latching mechanism to the door frame, that is, to a stationary receiving lug mounted to the door frame, wherein the latch pivots on contact with the lug during door closure to the door frame, to capture the receiving lug in an automatic fashion. A pair of locking plates are used to prevent tampering with the latch to position it in a "locked" position when the door is open. Such tampering would prevent the door from being closed and latched completely, even though the door is moved to a closed position.

A spring loaded wedge is driven into interfering engagement with the rotatable latch once the latch has been rotated into the locked position, which, in turn, can occur only when the plates have been depressed. Operation of the panic bar, or key operated opening mechanism is required to move the wedge out of its interfering position.

The invention requires no aperture in the door frame for receiving a bolt therein, hence alignment problems between the bolt and such aperture are avoided. The receiving lug can be positionally aligned more easily than can an actual aperture cavity cut into a door frame.

The pivoting engagement of the latch allows for an over closure of the door. The U-shape recess in the latch has sufficient pivot play that the latch can capture the lug and continue to rotate a small amount after complete capture of the lug into the U-shape recess. This feature allows over travel of the latch during closure.

The latch and lug arrangement eliminates the need for a spring loaded horizontally driven latch bolt arrangement which can be susceptible to tampering and retraction by use of a credit card or screwdriver.

The latch mechanism of the present invention provides a durable, long-lasting, simple, easily manufactured, and cost efficient arrangement. The present invention provides a latching assembly which can be used with a conventional rim type panic exit device and appertaining mechanical components.

BRIEF DESCRIPTION OF THE DRAWINGS

FIG. 8 is a side elevational view of a latch rib portion of the latch mechanism;

FIG. 9 is a side elevational view of the latch rib of FIG. 8, rotated 90°;

FIG. 10 is an end view of the latch rib of FIGS. 8 and 9;

FIG. 11 is an end elevational view of a latch frame portion of the latch mechanism;

FIG. 12 is a side elevational view of the latch frame of FIG. 11;

FIG. 13 is a side elevational view of the latch frame of FIG. 12 rotated 90°;

FIG. 15 is a side elevational view of a latch plate of the latch mechanism;

FIG. 16 is an end elevational view of the latch plate of FIG. 15;

DETAILED DESCRIPTION OF THE PREFERRED EMBODIMENTS

Figure 2:
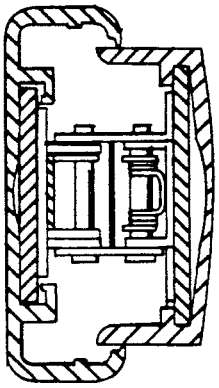
FIG. 2 is a sectional view taken generally along line II—II with the device in an extended position.
Figure 2A:
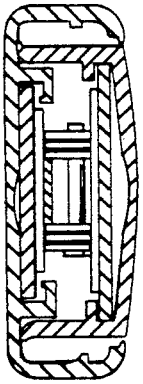
FIG. 2A is a sectional view taken generally along line II—II but with the device in a depressed position.
Figure 1:
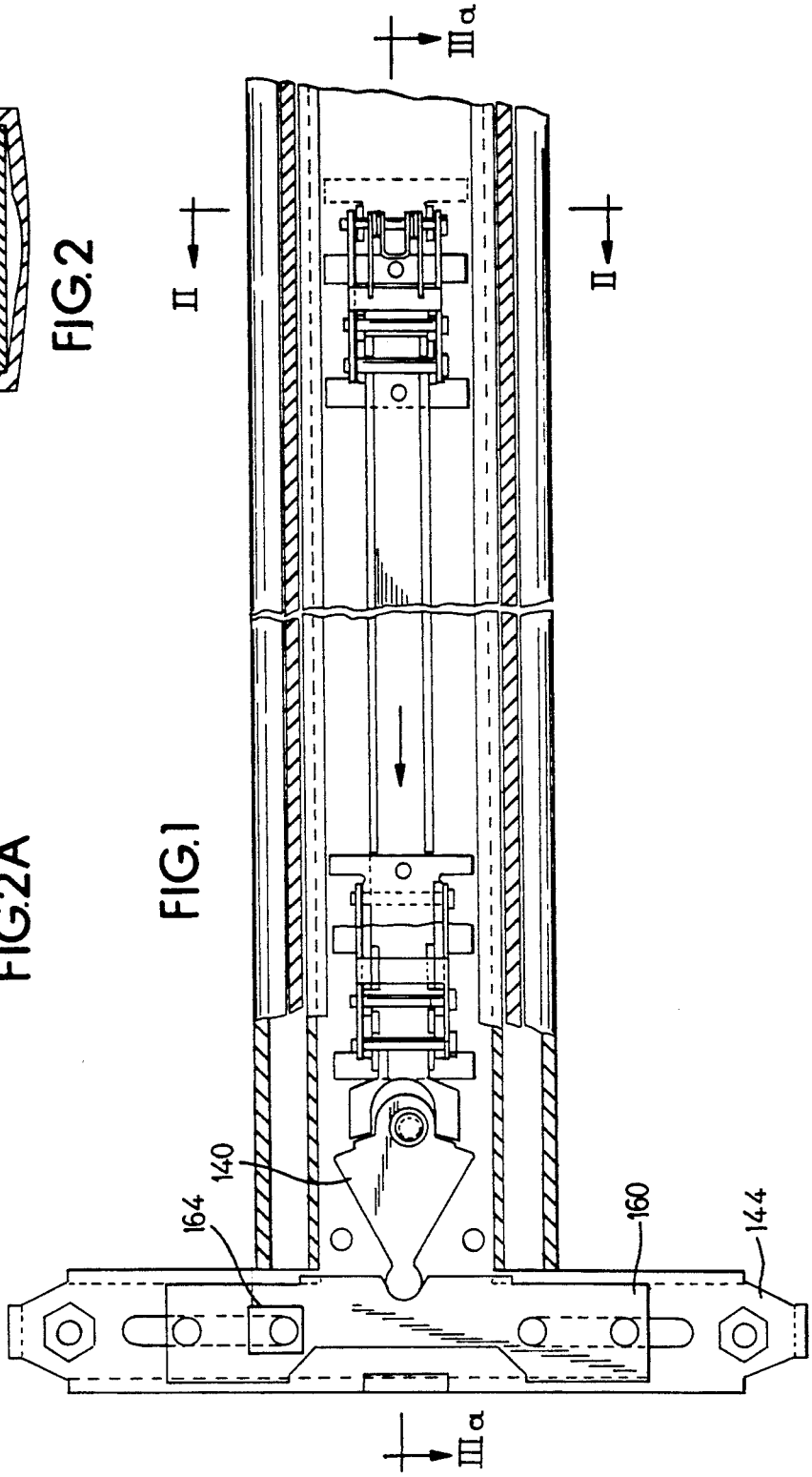
FIG. 1 is a partial elevational and cross-sectional view of a panic exit device embodying the present invention with certain elements removed for clarity.
Figure 3C:
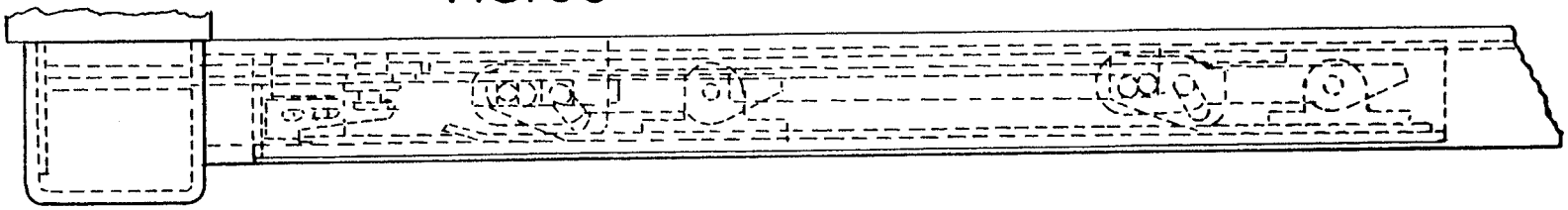
FIGS. 3*a*-3*c* are sectional views taken generally along line IIIa—IIIa of FIG. 1, in three stages of compression.
Figure 3B:
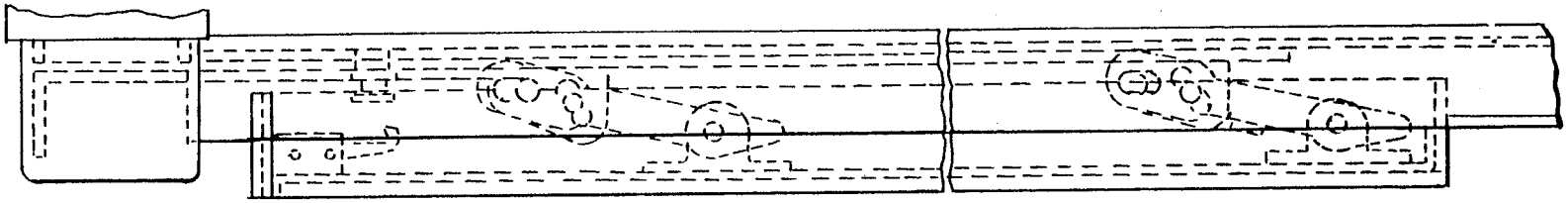
Figure 3A:
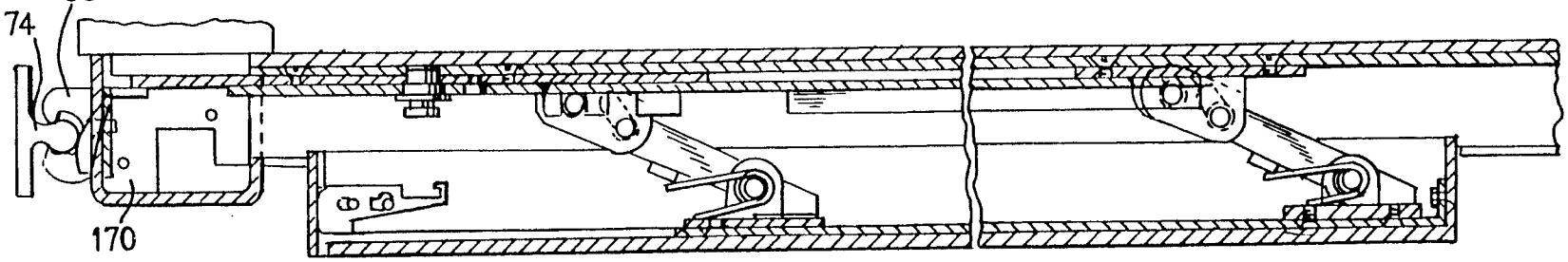

FIGS. 1-3 show a panic exit device generally at 30. The operation of the panic exit device 30 is disclosed in U.S. Ser. No. 787,261 filed Nov. 4, 1991 and that description is incorporated herein by reference.

The panic exit device 30 operates to release a latch 68 from engagement with a receiving lug or strike 74 mounted in a side frame member of the door frame.

Figure 4:
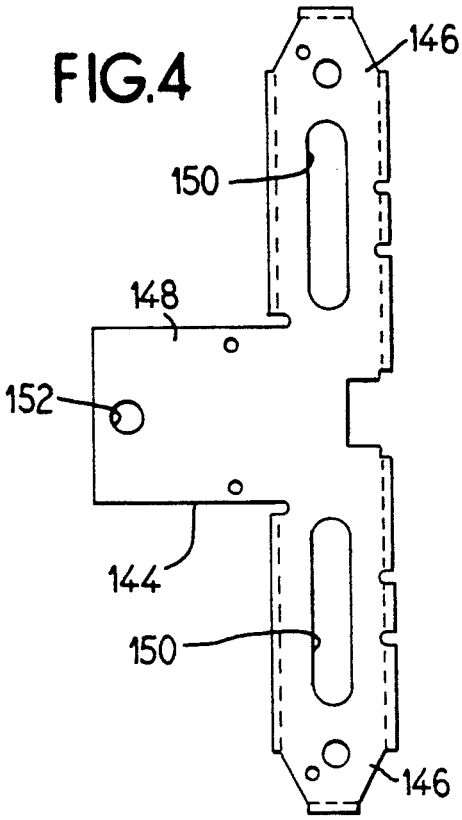
FIG. 4 is a side elevational view of a head base mounting platform for the latch mechanism.
Figure 5:
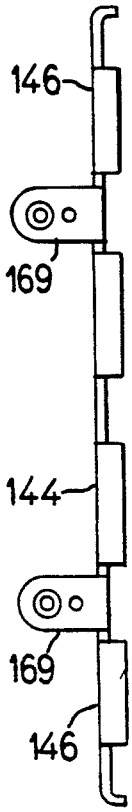
FIG. 5 is top elevational view of the head base shown in FIG. 4.
Figure 6:
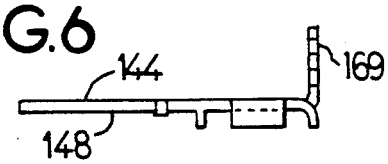
FIG. 6 is an end elevational view of the head base shown in FIG. 4.
Figure 7:
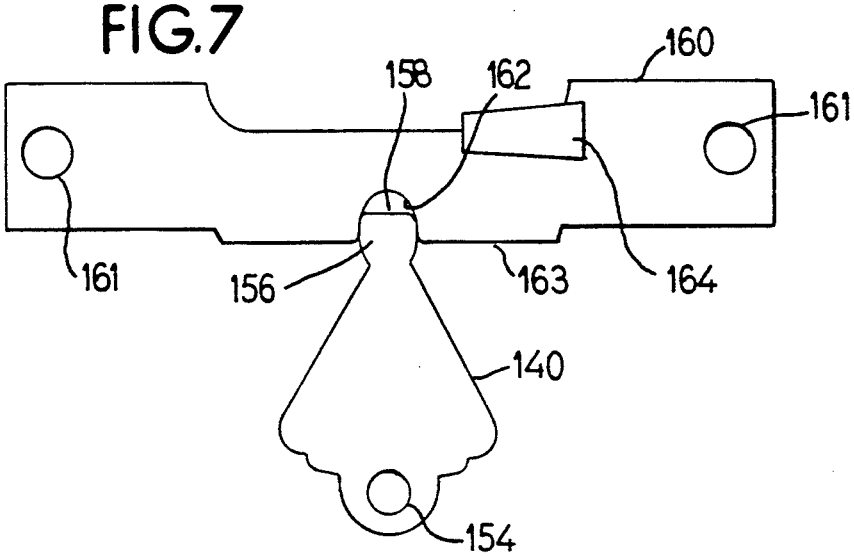
FIG. 7 is a side elevational view of a slide member and a slide actuator for the latch mechanism.

The latch mechanism 142 is comprised of a number of individual pieces. A head base 144 (FIGS. 4-6) is provided as a mounting platform for several of the individual pieces. The head base 144 has a general T-shape with two upper arms 146 extending from a central member 148. A slot 150 is provided in each of the upper arms 146. An opening 152 for receiving a pivot pin 154 (FIG. 7) is provided in the lowermost portion of the central member 148. The pivot pin 154 carries a slide actuator 140 which freely pivots on the pivot pin 154. The slide actuator 140 has a rounded head portion 156 at an end 158 opposite its connection to the pivot pin 154.

A slide member 160 (FIG. 7) is carried on the head base 144 by slide pins 161 which extend through the slots 150 in the arms 146. A recess 162 in one edge 163 of the slide 160 receives the head portion 156 of the slide actuator 140. Pivoting of the slide actuator 140 results in a sliding movement of the slide 160. The slide 160 carries a wedge 164 which projects from one face of the slide. A spring 165 continuously biases the wedge 164 on the slide towards the latch 68.

A latch rib 166 (FIGS. 8-10) is secured to the head base 144 by appropriate fasteners through tabs 167 on the latch rib and tabs 169 on the head base. The latch rib 166 has a strap portion 168 which overlies part of a latch frame 170 to hold the latch frame in position on the head base 144.

The latch frame 170 (FIGS. 11-13) is mounted onto the base 144 by means of slots 172 which are engaged by portions 174 (FIG. 4) of the head base. The frame 170 has two parallel spaced apart walls 176 and an end wall 178 that define a cubical space 180 which is open at one end 182. Two pairs of holes 184 are provided in the walls 176 to receive pivot/guide pins 186, 188 (FIGS. 17-21). A wide slot 190 is formed in a top wall 192 of the latch frame 170 to receive the strap portion 168 of the latch rib 166.

Figure 14:
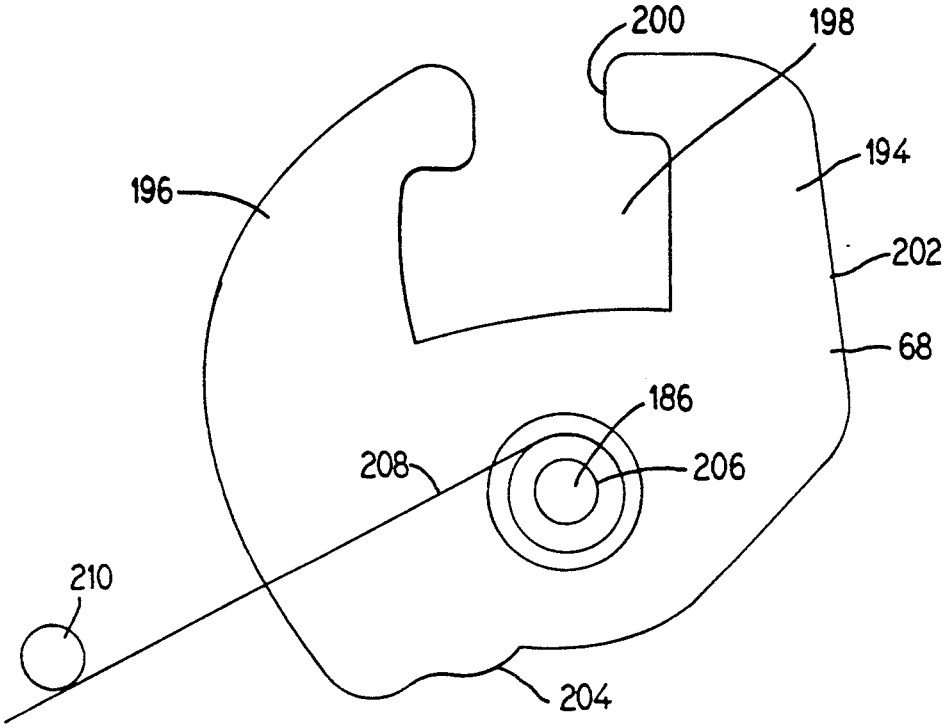
FIG. 14 is a side elevational view of the latch and spring of the latch mechanism.
Figure 21:
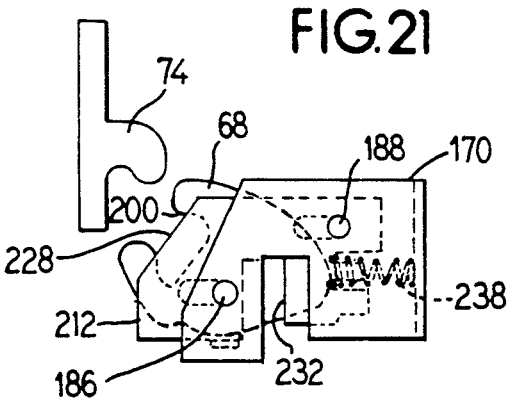
FIG. 21 is a top view of the latch mechanism in the open position.
Figure 22:
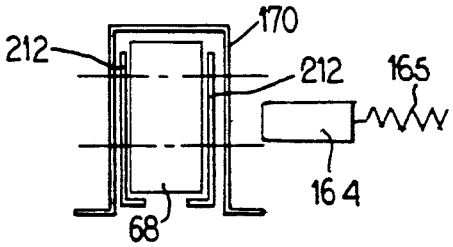
FIG. 22 is a side schematic view of the latch mechanism in the open position.
Figure 17:
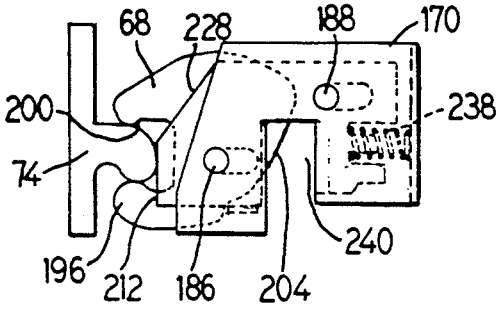
FIG. 17 is a top view of the latch mechanism in the closed position.
Figure 18:
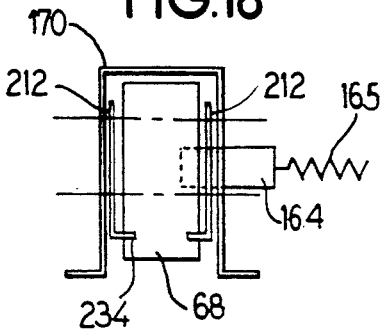
FIG. 18 is a side schematic view of the latch mechanism in the closed position.

The latch 68 (FIG. 14) is formed in a U-shape having a pair of upstanding legs 194, 196 defining a large slot 198 within an opening 200 therebetween. An outer periphery 202 of the latch 68 has a stepped contour 204 opposite the slot opening 200. The latch 68 has a hole 206 therethrough to permit passage of the pivot/guide pin 186. A tension spring 208 is carried on the pivot pin 186 which engages the latch 68 at one end and engages a fixed member 210 on the latch frame 170 at the other end to continuously bias the latch into its open position. The latch 68 is carried in the cubical space 180 formed in the latch frame 170.

A pair of plates 212 (FIGS. 15-16) are provided which are positioned within the cubical space 180 of the latch frame 170, outboard of the latch 68. Each plate 212 has a pair of slots 214, 216 therethrough to receive the pivot/guide pins 186, 188. One end 218 of each plate has a pair of notches 220 leaving a finger 222 therebetween. The finger 222 has a pair of opposite bends 224, 226 therein to cause the finger to extend parallel to the plate 212, but laterally offset therefrom. An opposite end 228 of the plate 212 is sloped relative to the side edges 230. One of the side edges 230 has a rectangular cutout 232 therein. Adjacent to each end of the cutout 232 is a tab 234, 236, which tabs project at an angle of approximately 90 degrees to the large surface of the plate 212.

Figure 23:
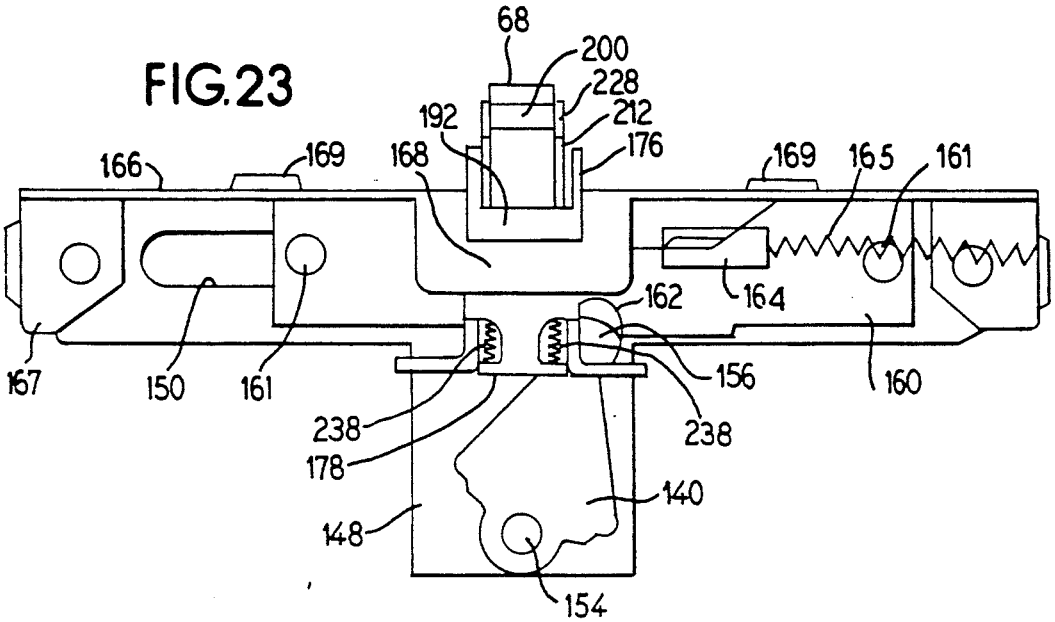
FIG. 23 is a side elevational view of the latch mechanism in the open position.
Figure 19:
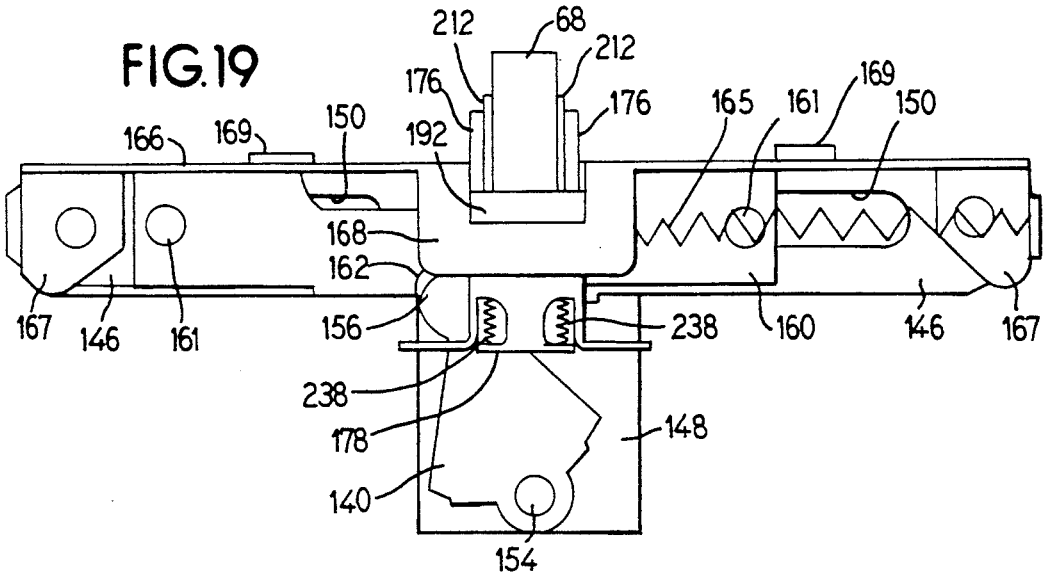
FIG. 19 is a side elevational view of the latch mechanism in the closed position.
Figure 20:
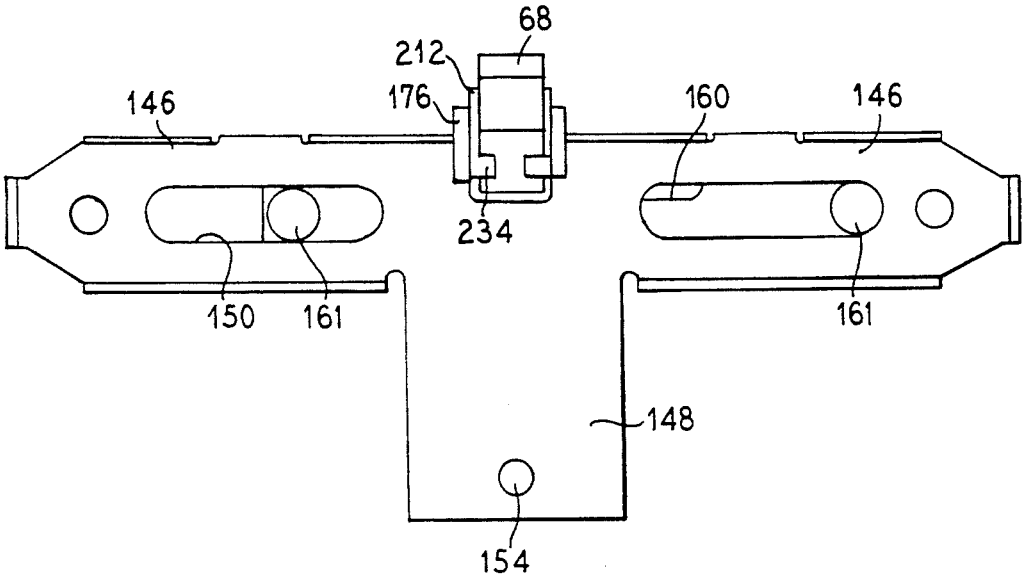
FIG. 20 is an opposite side elevational view from FIG. 19 of the latch mechanism in the closed position.
Figure 24:
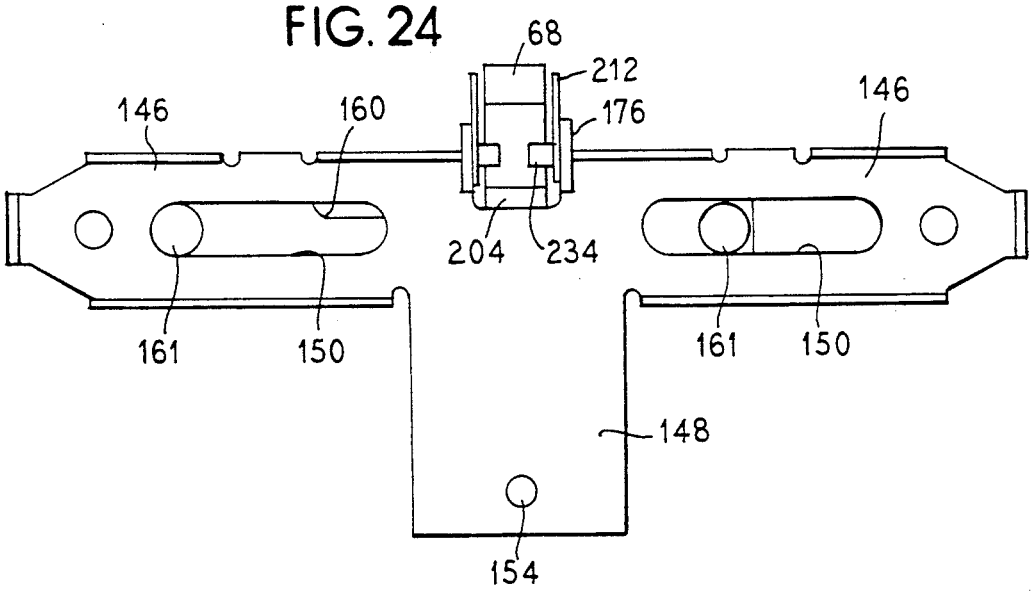
FIG. 24 is an opposite side elevational view from FIG. 19 of the latch mechanism in the open position.

The tabs 234, 236 extend inwardly of the plates 212 to overlie a portion of the latch 68. The fingers 222 carry springs 238 (FIG. 17) which abut on the inside surface of the latch frame end wall 178 (FIGS. 19, 23). The sloped end 228 projects out of the open end 182 of the frame 170, as does the open end 200 of the latch 68.

When the latch 68 and door 12 are in the closed position, as shown in FIGS. 2, 3, and 17-20, the slot opening 200 receives the strike 74, to hold the door in a closed position. The strike 74 has moved the plates 212 against the bias of their springs 238, and has rotated the latch 68 against its spring 208, thus opening a window 240 (FIG. 17) into which the wedge 164 has been biased by its spring 165. The wedge 164 is held in the window 240, at the stepped contour 204 of the latch 68, preventing the latch from rotating. Thus the latch 68 is held in a locked condition relative to the strike 74.

When the panic exit device or key is used to pivot the slide actuator 140 against the bias of spring 165, the slide member 160 will move to the right (FIG. 23), extracting the wedge 164 from the window 240 and away from engagement with the latch 68, thereby permitting the latch to rotate, releasing its engagement with the strike 74. The spring 208 assists in the rotation of the latch 68. Rotation of the latch 68 causes the latch to rotate into the window 240 (FIG. 21), thus preventing the wedge 164 from returning to the window to block the latch. As the latch 68 moves away from the strike 74, plates 212 are permitted to move under the influence of their springs 238. When the latch 68 has fully rotated (approximately 30 degrees), the plates 212 will slide into their extended position as permitted by the slots 214 and 216. The tabs 234, 236 on the plates 212 will then engage a portion of the periphery 202 of the latch 68, preventing the latch from rotating back to the closed position. Also, the rectangular cutout 232 of the plates 212 will slide over into the position of the window 240, thus also preventing the wedge 164 from re-entering the window area. Upon release of the panic bar or key, the wedge 164 will be biased against an outer surface of one of the plates 212 (FIGS. 21-24).

To prevent tampering of the latch 68, both plates 212 must be depressed against the bias of their springs 238 in order to permit the latch to then be rotated against the bias of its spring 208 towards the locked position. The depression of the plates 212 occurs when the door 12 is moved to a closing position. When the strike 74 approaches the latch mechanism 142, it will first engage the sloping edges 228 of the plates, camming them against their springs 238. Once the tabs 234, 236 have moved away from the latch 68, the strike 74 will engage the inside surface of one of the legs 196 of the latch to rotate it against the bias of its spring 208. As the plates 212 slide away from the strike 74, and as the latch 68 rotates, the window 240 again opens permitting the wedge 164, which has been biased against the side of one of the plates, to move into the window blocking the latch in the locked position.

Although the top assemblage comprising the top latch 68, the slide actuator 140, the third link 128, the second reversing link 120, and the connector 116 have been described and depicted with respect to engaging a top of the door stile 140 to the top door frame 75, it is within the scope of the invention to invert this top assemblage for a bottom mounting to engage with a bottom frame member of the door frame, (replacing the bottom latch 62) alone or in conjunction with the top assemblage herein described, and such application is encompassed by the invention.

Although the present invention has been described with reference to a specific embodiment, those of skill in the art will recognize that changes may be made thereto without departing from the scope and spirit of the invention as set forth in the appended claims.

We claim as our invention:

1. A latch arrangement for a door in swinging engagement with a door frame, comprising:

a strike mounted to the door frame and facing toward said door;

a latch rotatably mounted with respect to said door facing said strike, having a cavity arranged and adapted for capturing said strike therein, said latch rotatable from a first position in a first rotational direction toward a second position to release said strike from said cavity, and said latch rotatable from said second position to said first position in a second rotational direction to capture said strike in said cavity;

a first means for selectivity preventing rotation of said latch in said first direction;

a second means for selectivity preventing rotation of said latch in said second direction comprising a pair of independently movable plates, each having a tab projecting therefrom to engage said latch when said plates are in an extended position, said tab being moved out of engagement with said latch when said plates are moved into a recessed position;

biasing means for biasing said plates into said extended position; and means for depressing said plates into said recessed position.

2. A latch arrangement according to claim 1, wherein said strike comprises a T-shape with a stem portion receivable by said cavity and a base portion anchorable to said door frame.

3. A latch arrangement according to claim 1, wherein said first means comprises a wedge biased into blocking engagement with said latch.

4. A latch arrangement according to claim 1, wherein said cavity is formed with a generally rectangular trough formed into an outward facing surface of said latch, forming a leading leg and a trailing leg, and said strike comprises a stem portion extending from said door frame toward said cavity.

5. A latch arrangement for use in selectivity securing a door in a closed position relative to a door frame, comprising:

a first latch member mounted on said door frame;

a second latch member pivotally mounted on said door and having a portion engageable with said first latch member in a first rotational position to secure said door closed relative to said door frame and disengageable from said first latch member in a second rotational position to permit opening of said door relative to said frame;

a wedge shaped member for applying a retaining force on said second latch member in said first rotational position to prevent said second latch member from rotating from said first rotational position, including means for biasing said wedge member into engagement with said second latch member and means for moving said wedge member away from said second latch member;

means for applying force on said second latch member in said second rotational position comprising a pair of independently movable plates, each plate having tabs projecting therefrom to engage said second latch member when said plates are in an extended position, said tabs being moved out of engagement with said second latch member when said plates are moved into a recessed position;

biasing means for biasing said plates into said extended position; and means for depressing said plates into said recessed position.

6. A latch arrangement for use in selectively securing a door in a closed position relative to a door frame, comprising:

a first latch member mounted on said door frame;

a second latch member pivotally mounted on said door and having a portion engageable with said first latch member in a first rotational position to secure said door closed relative to said door frame and disengageable from said first latch member in a second rotational position to permit opening of said door relative to said frame;

means for applying a retaining force on said second latch member in both said first and second rotational positions to prevent said second latch member from rotating from either of said positions;

said means for preventing said second latch member from rotating from its said second position comprising a pair of independently movable members, each having a portion to engage said second latch member when said members are both in a first position, said members being moved out of engagement with said second latch member when said members are moved into a second position;

means for selectively overcoming said retaining force to permit said second latch member to move between said first and second rotational positions including means for moving said members into their said first position when said second latch member is in its said second position and means for moving said members into their said second position when said second latch member is in its said first position.

7. A latch arrangement according to claim 6, wherein said pair of independently movable members comprise a pair of independently movable plates, each plate having a tab projecting therefrom to engage said second latch member when said plates are in their first position.

8. A latch arrangement according to claim 7, wherein said first position of said plates comprises an extended position and said second position of said plates comprises a recessed position.

9. A latch arrangement according to claim 8, wherein biasing means are provided for biasing said plates into said extended position.

* * * * *